US012631348B2

(12) United States Patent
Hara

(10) Patent No.: US 12,631,348 B2
(45) Date of Patent: May 19, 2026

(54) CENTRIFUGAL BLOWER, AND INDOOR UNIT

(71) Applicant: Mitsubishi Electric Corporation, Tokyo (JP)

(72) Inventor: Junya Hara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 100 days.

(21) Appl. No.: 18/703,586

(22) PCT Filed: Jan. 17, 2022

(86) PCT No.: PCT/JP2022/001286

§ 371 (c)(1),
(2) Date: Apr. 22, 2024

(87) PCT Pub. No.: WO2023/135782

PCT Pub. Date: Jul. 20, 2023

(65) Prior Publication Data

US 2024/0418377 A1 Dec. 19, 2024

(51) Int. Cl.
*F24F 1/0022* (2019.01)
*F04D 25/08* (2006.01)
(Continued)

(52) U.S. Cl.
CPC ..... *F24F 1/0022* (2013.01); *F04D 25/082* (2013.01); *F04D 29/5806* (2013.01); *F24F 1/0047* (2019.02)

(58) Field of Classification Search
CPC ... F24F 1/0047; F24F 1/0022; F04D 29/5806; F04D 25/082
See application file for complete search history.

(56) References Cited

U.S. PATENT DOCUMENTS

2005/0103042 A1* 5/2005 Sanagi ..... F24F 1/0022 62/419
2023/0204229 A1* 6/2023 Kim ..... F24F 13/24 165/122

FOREIGN PATENT DOCUMENTS

JP S60164699 U * 11/1985
JP H11101194 A * 4/1999
(Continued)

OTHER PUBLICATIONS

Translation of JP2000205195A named Translation—JP2000205195A (Year: 2000).*

(Continued)

*Primary Examiner* — Paul Alvare
(74) *Attorney, Agent, or Firm* — Posz Law Group, PLC

(57) ABSTRACT

A centrifugal blower includes: a drive portion having a rotary shaft that rotates about a rotation axis; and an impeller configured to be rotated forward in a rotation direction around the rotation axis by the drive portion, in which the impeller includes a main plate, a shroud facing the main plate in the axial direction, and a plurality of vane portions connecting the main plate and the shroud, the main plate has a hub that covers the drive portion and has a plurality of guide portions protruding outward in the radial direction and arranged in the rotation direction, air holes are formed in the plurality of guide portions, and each outer peripheral surfaces of the plurality of guide portions has a pair of peripheral surface portions located on front and rear sides in the rotation direction with respect to the air hole and facing outward in the radial direction.

8 Claims, 7 Drawing Sheets

(51) Int. Cl.
*F04D 29/58* (2006.01)
*F24F 1/0047* (2019.01)

(56) References Cited

FOREIGN PATENT DOCUMENTS

| | | | | | |
|---|---|---|---|---|---|
| JP | 2000205195 | A | * | 7/2000 | ..... F04D 29/5806 |
| JP | 2000227231 | A | * | 8/2000 | ..... F04D 29/5806 |
| JP | 2004-340087 | A | | 12/2004 | |
| JP | 2006284091 | A | * | 10/2006 | |
| JP | 2009221928 | A | * | 10/2009 | |
| WO | 2004/055380 | A1 | | 7/2004 | |
| WO | WO-2015104837 | A1 | * | 7/2015 | ..... F24F 1/0022 |
| WO | WO-2015104838 | A1 | * | 7/2015 | ..... F04D 29/684 |
| WO | WO-2022055136 | A1 | * | 3/2022 | ..... F24F 13/20 |

OTHER PUBLICATIONS

Translation of JP2009221928A named Translation—JP2009221928A (Year: 2009).*

Office Action dated Jan. 7, 2025 issued for the corresponding Japanese Patent Application No. 2023-573783 (and English translation).

International Search Report of the International Searching Authority mailed Mar. 15, 2022 in corresponding International Application No. PCT/JP2022/001286 (and English translation).

* cited by examiner

CENTRIFUGAL BLOWER, AND INDOOR UNIT

CROSS-REFERENCE TO RELATED APPLICATION

This application is a U.S. National Stage Application of International Application No. PCT/JP2022/001286 filed Jan. 17, 2022, the contents of which are incorporated herein by reference.

TECHNICAL FIELD

The present disclosure relates to a centrifugal blower and an indoor unit.

BACKGROUND

A ceiling-embedded type indoor unit of an air conditioner has an air inlet and an air outlet formed on a device lower surface facing a room to be air-conditioned. A temperature of air suctioned into a case from the air inlet is regulated by a heat exchanger in the case, and then the air is sent out from the air outlet to the room. The above-described air flow of the indoor unit is created by a centrifugal blower that suctions air upward from below and blows out the air by diverting the flow outward in a radial direction. The centrifugal blower includes a shroud, a main plate, and a plurality of vane portions that connect the shroud and the main plate to each other. In such a centrifugal blower, a main flow that is directed radially outward is formed between the main plate and the shroud.

In addition to the above-described main flow, a structure in which a sub-flow that is directed radially inward on an upper side of the main plate is generated to cool a fan motor is disclosed in Patent Document 1. In the centrifugal blower of Patent Document 1, a blowing-out direction of the sub-flow is set to a rear side in a rotation direction of the main plate by an air guide portion, thereby suppressing generation of noise accompanying the merging of the sub-flow and the main flow.

PATENT DOCUMENT

Patent Document 1

PCT International Publication No. WO2004/055380

In the indoor unit as described above, a flow path resistance of the sub-flow is increased in order to abruptly bend a flow direction of the air of the sub-flow. Therefore, in the structure in the related art, there is a problem in that an air volume of the sub-flow is reduced and a cooling efficiency of the fan motor is likely to deteriorate.

SUMMARY

In view of the above circumstances, an object of the present disclosure is to provide a centrifugal blower and an indoor unit capable of sufficiently securing a flow rate of a sub-flow while suppressing noise.

According to one aspect of the present disclosure, there is provided a centrifugal blower including: a drive portion having a rotary shaft that rotates about a rotation axis; and an impeller that is disposed on one side in an axial direction of the rotation axis with respect to the drive portion and is configured to be rotated forward in a rotation direction around the rotation axis by the drive portion, in which the impeller includes a main plate fixed to the rotary shaft, a shroud having an annular shape and facing the main plate in the axial direction, and a plurality of vane portions connecting the main plate and the shroud, the main plate has a hub that covers the drive portion from the one side in the axial direction and from an outside in a radial direction of the rotation axis, the hub has a plurality of guide portions protruding outward in the radial direction and arranged in the rotation direction, air holes that are open outward in the radial direction are formed in the plurality of guide portions, and each outer peripheral surfaces of the plurality of guide portions has a first peripheral surface portion and a second peripheral surface portion, the first peripheral surface portion being located on a front side in the rotation direction with respect to the air hole and facing outward in the radial direction, the second peripheral surface portion being located on a rear side in the rotation direction with respect to the air hole and facing outward in the radial direction, and the second peripheral surface portion extends in the rotation direction and is disposed to be continuous to an opening of the air hole in the rotation direction.

According to another aspect of the present disclosure, there is provided an indoor unit including: the above-described centrifugal blower; and a heat exchanger disposed around the centrifugal blower.

According to the present disclosure, a centrifugal blower and an indoor unit capable of sufficiently securing a flow rate of a sub-flow while suppressing noise are provided.

DETAILED DESCRIPTION

Figure 1:
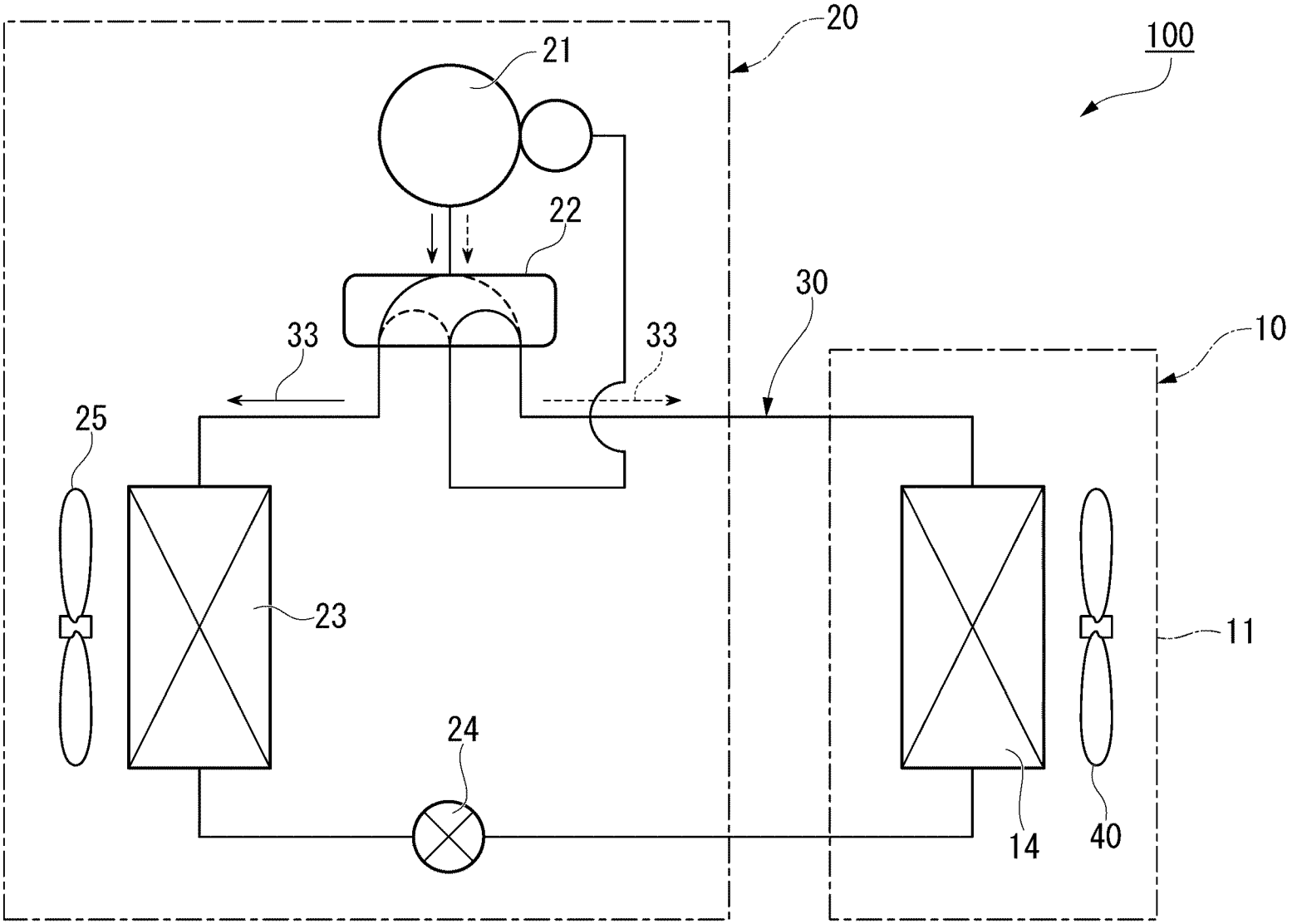
FIG. 1 is a schematic diagram showing a schematic configuration of an air conditioner in an embodiment.

Hereinafter, an embodiment of the present disclosure will be described with reference to the drawings. The scope of the present disclosure is not limited to the following embodiment, and can be changed in any way within the scope of technical ideas of the present disclosure. In addition, in the following drawings, a scale and the number in each structure may be different from a scale and the number in an actual structure to facilitate understanding of each configuration.

In addition, in the drawings, a Z axis indicating a vertical direction is shown as appropriate. A side (+Z side) to which an arrow of the Z axis points in the vertical direction is an upper side, and a side (−Z side) opposite to the side to which the arrow of the Z axis points in the vertical direction is a lower side. A posture of an indoor unit 10 in the vertical direction described in the embodiment is merely an example, and does not limit an assembly posture of the indoor unit 10.

FIG. 1 is a schematic diagram showing a schematic configuration of an air conditioner 100 according to the present embodiment. As shown in FIG. 1, the air conditioner 100 includes an indoor unit 10, an outdoor unit 20, and a circulation path portion 30. The indoor unit 10 is disposed indoors. The outdoor unit 20 is disposed outdoors. The indoor unit 10 and the outdoor unit 20 are connected to each other by the circulation path portion 30 through which a refrigerant 33 circulates. The indoor unit 10 and the outdoor unit 20 are heat exchange units that perform heat exchange with air.

The air conditioner 100 can regulate a temperature of indoor air by exchanging heat between the refrigerant 33 flowing inside the circulation path portion 30 and air inside a room in which the indoor unit 10 is disposed. Examples of the refrigerant 33 include a fluorine-based refrigerant having a low global warming potential (GWP) and a hydrocarbon-based refrigerant.

The outdoor unit 20 has a compressor 21, an outdoor heat exchanger 23, a flow regulating valve 24, a blower 25, and a four-way valve 22. The compressor 21, the outdoor heat exchanger 23, the flow regulating valve 24, and the four-way valve 22 are connected by the circulation path portion 30.

The four-way valve 22 is provided in a portion of the circulation path portion 30 connected to a discharge side of the compressor 21. The four-way valve 22 can reverse a direction of the refrigerant 33 flowing inside the circulation path portion 30 by switching a part of the circulation path portion 30. When a path connected by the four-way valve 22 is a path indicated by a solid line in the four-way valve 22 in FIG. 1, the refrigerant 33 flows inside the circulation path portion 30 in a direction indicated by a solid line arrow in FIG. 1. On the other hand, when the path connected by the four-way valve 22 is a path indicated by a broken line in the four-way valve 22 in FIG. 1, the refrigerant 33 flows inside the circulation path portion 30 in a direction indicated by a broken line arrow in FIG. 1.

The indoor unit 10 has a centrifugal blower 40 and an indoor heat exchanger (heat exchanger) 14 disposed around the centrifugal blower 40. The indoor unit 10 can perform a cooling operation of cooling the air inside the room in which the indoor unit 10 is disposed and a heating operation of warming the air inside the room in which the indoor unit 10 is disposed.

When the indoor unit 10 performs the cooling operation, the refrigerant 33 flowing inside the circulation path portion 30 flows in the direction indicated by the solid line arrow in FIG. 1. That is, when the indoor unit 10 performs the cooling operation, the refrigerant 33 flowing inside the circulation path portion 30 circulates to return to the compressor 21 after circulating through the compressor 21, the outdoor heat exchanger 23 of the outdoor unit 20, the flow regulating valve 24, and the indoor heat exchanger 14 of the indoor unit 10 in this order. In the cooling operation, the outdoor heat exchanger 23 inside the outdoor unit 20 functions as a condenser, and the indoor heat exchanger 14 inside the indoor unit 10 functions as an evaporator.

On the other hand, when the indoor unit 10 performs the heating operation, the refrigerant 33 flowing inside the circulation path portion 30 flows in the direction indicated by the broken line in FIG. 1. That is, when the indoor unit 10 performs the heating operation, the refrigerant 33 flowing inside the circulation path portion 30 circulates to return to the compressor 21 after circulating through the compressor 21, the indoor heat exchanger 14 of the indoor unit 10, the flow regulating valve 24, and the outdoor heat exchanger 23 of the outdoor unit 20 in this order. In the heating operation, the outdoor heat exchanger 23 inside the outdoor unit 20 functions as an evaporator, and the indoor heat exchanger 14 inside the indoor unit 10 functions as a condenser.

Next, the indoor unit 10 of the present embodiment will be described in more detail.

Figure 2:
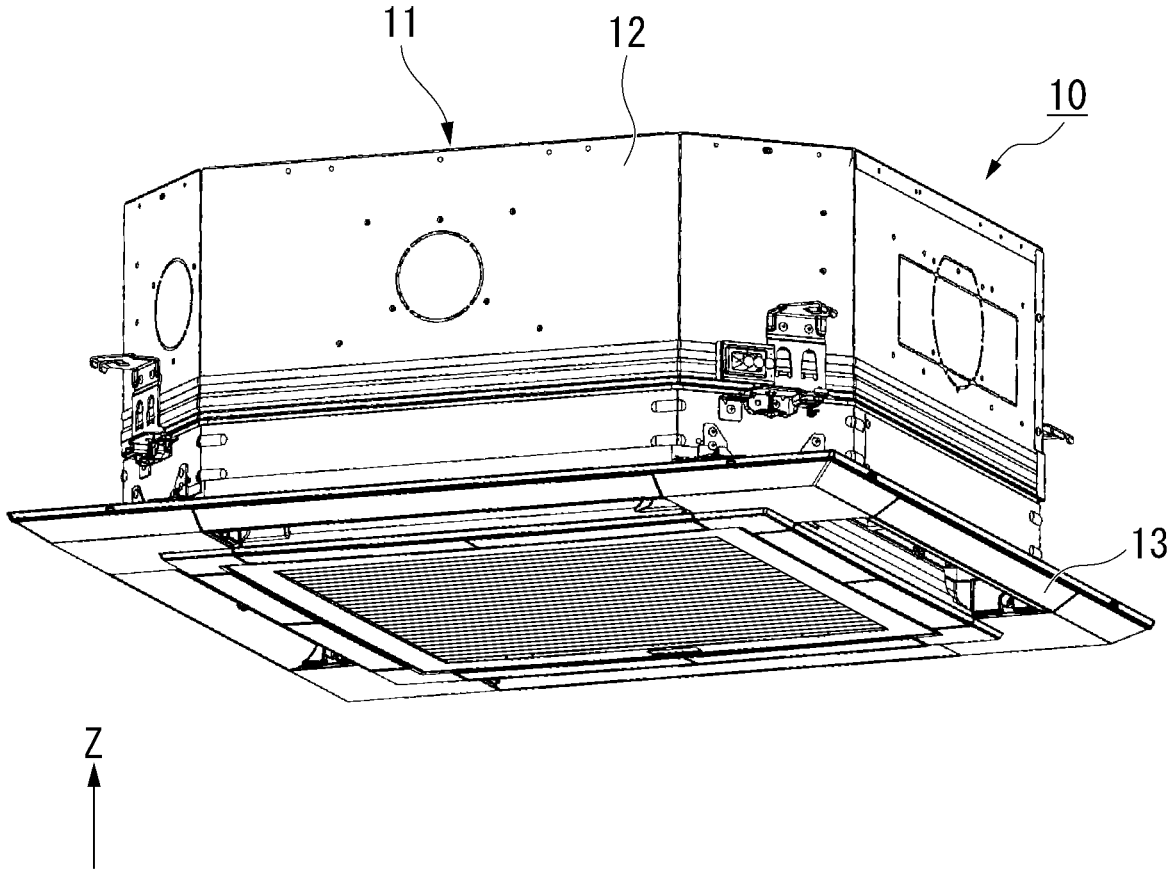
FIG. 2 is a perspective view showing an indoor unit in the embodiment.
Figure 3:
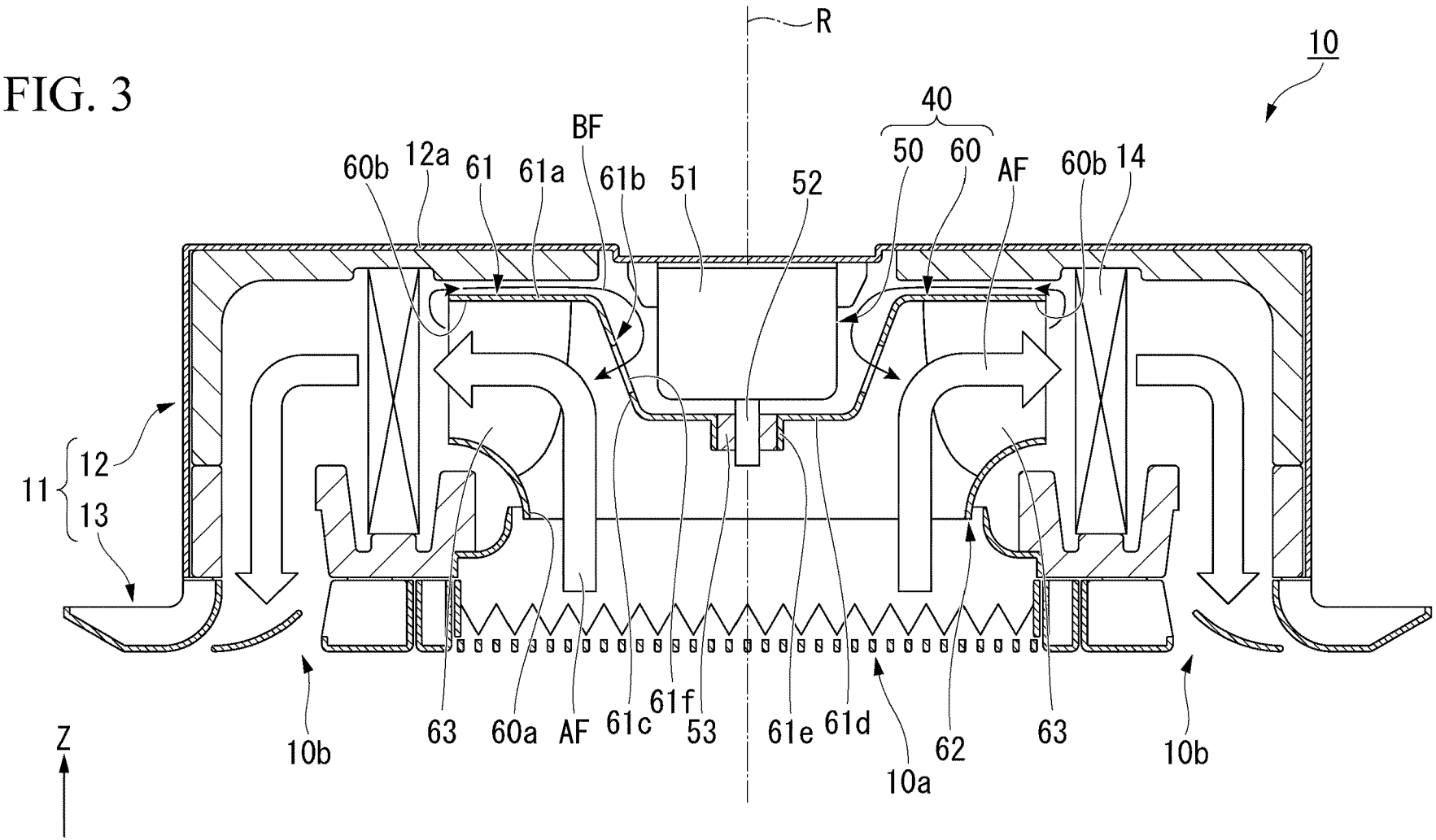
FIG. 3 is a schematic sectional view showing the indoor unit in the embodiment.

FIG. 2 is a perspective view showing the indoor unit 10. FIG. 3 is a schematic sectional view showing the indoor unit 10.

In each of FIG. 3 and subsequent figures, a rotation axis R is appropriately shown. The rotation axis R is an imaginary line passing through the center of the centrifugal blower 40 in the following embodiment. An impeller 60 of the centrifugal blower 40 rotates around the rotation axis R. A direction in which the rotation axis R of the present embodiment extends is a vertical direction.

In the following description, an axial direction of the rotation axis R, that is, a direction parallel to the Z axis may be simply referred to as an "axial direction", a radial direction about the rotation axis R may be simply referred to as a "radial direction", and a circumferential direction about the rotation axis R may be simply referred to as a "circumferential direction". In addition, in the following description, a lower side in the vertical direction (−Z side) may be referred to as one side in the axial direction, and an upper side in the vertical direction (+Z side) may be referred to as the other side in the axial direction. Furthermore, in the following description, the term "outside in the radial direction (outward in the radial direction)" means a side apart from the rotation axis R in the radial direction, and the "inside in the radial direction (inward in the radial direction)" means a side approaching the rotation axis R on an opposite side to the "outside in the radial direction" in the radial direction.

The indoor unit 10 of the present embodiment is a ceiling-embedded indoor unit that is installed by being embedded in a ceiling. As shown in FIG. 3, the indoor unit 10 includes a housing 11 in addition to the centrifugal blower 40 and the indoor heat exchanger 14. The housing 11 includes a housing body portion 12 that covers the centrifugal blower 40 and the indoor heat exchanger 14 from the upper side, and a decorative panel 13 that is located on the lower side of the centrifugal blower 40 and the indoor heat exchanger 14. The housing body portion 12 has a flat plate-shaped top plate portion 12*a* orthogonal to the rotation axis R. The indoor heat exchanger 14 and the centrifugal blower 40 are fixed to a lower surface of the top plate portion 12*a*. In addition, an air inlet 10*a* and an air outlet 10*b* are formed in the decorative panel 13.

The centrifugal blower 40 has a drive portion 50 and an impeller 60. The drive portion 50 is, for example, a fan motor. The drive portion 50 has a drive portion body 51 and a rotary shaft 52. The drive portion body 51 is fixed to the top plate portion 12*a* of the housing 11. The rotary shaft 52 rotates about the rotation axis R. The impeller 60 is disposed on the lower side (one side in the axial direction) with respect to the drive portion 50. The impeller 60 is rotated around the rotation axis R by the drive portion 50.

When the drive portion 50 is driven and the impeller 60 is rotated, the air in the room in which the indoor unit 10 is installed is suctioned into the indoor unit 10 from the air inlet 10*a*. The air suctioned into the indoor unit 10 is further suctioned into the impeller 60 from an intake port 60*a* of the impeller 60. The air suctioned into the impeller 60 flows outward in the radial direction inside the impeller 60 as a vane portion 63 of the impeller 60 rotates, and is blown out of the centrifugal blower 40 from an exhaust port facing outward in the radial direction. The air blown out from the centrifugal blower 40 passes through the indoor heat exchanger 14, is subjected to heat exchange and humidity regulation while passing through the indoor heat exchanger 14, and then is blown out from the air outlet 10*b* into the room by changing a flow direction thereof downward.

Here, a flow of air generated by the centrifugal blower 40 will be described. The centrifugal blower 40 generates a main flow AF and a sub-flow BF inside the indoor unit 10.

The main flow AF is an air flow that flows into the impeller 60 from the intake port 60*a*, is directed to the outside in the radial direction in a space between the main plate 61 and the shroud 62, and is blown out from the exhaust port 60*b* toward the indoor heat exchanger 14 on the outside in the radial direction. The main flow AF is formed to cause the indoor air to pass through the indoor heat exchanger 14 and return to the indoor space again.

The sub-flow BF is an air flow that diverges from the main flow AF at the exhaust port 60*b*, passes through the upper side (between the main plate 61 and the top plate portion 12*a*) of the impeller 60, flows downward around the drive portion 50, and merges with the main flow AF through an air hole 61*f* formed in the main plate 61. The sub-flow BF cools the drive portion 50 by taking heat from the drive portion 50 when passing around the drive portion 50. Therefore, the cooling efficiency of the drive portion 50 can be increased by sufficiently securing the flow rate of the sub-flow BF.

Next, the impeller 60 of the present embodiment will be described in detail.

Figure 4:
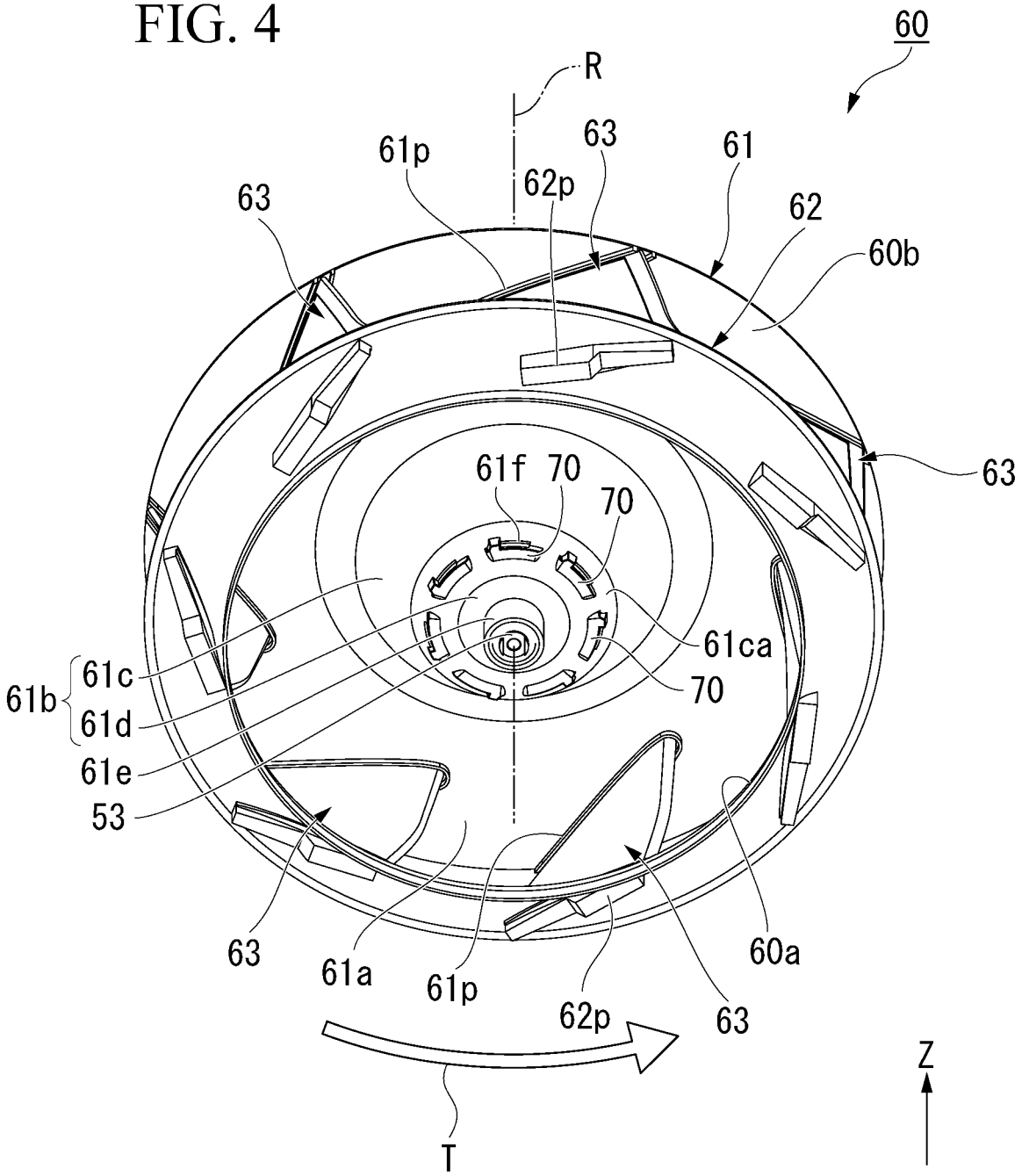
FIG. 4 is a perspective view of an impeller in the embodiment.

FIG. 4 is a perspective view of the impeller 60. In each of FIG. 4 and subsequent figures, a rotation direction T of the impeller 60 is indicated by an arrow. In the present embodiment, the rotation direction T is a counterclockwise direction in the circumferential direction when the impeller 60 is viewed from the lower side. In the following description, a direction toward the rotation direction T may be referred to as a front side in the rotation direction T, and a direction opposite to the front side may be referred to as a rear side in the rotation direction T. The impeller 60 is rotated forward in the rotation direction T by the drive portion 50.

The impeller 60 includes the main plate 61, the shroud 62, and a plurality of the vane portions 63. The main plate 61, the shroud 62, and the vane portions 63 are each formed of a resin material. The main plate 61, the shroud 62, and the vane portions 63 are fixed to each other and rotate around the rotation axis R.

The main plate 61 is fixed to the rotary shaft 52 of the drive portion 50 (refer to FIG. 3). The main plate 61 is rotated around the rotation axis R by the drive portion 50. The main plate 61 has a hub 61*b*, a shaft holding portion 61*e*, and a base 61*a*.

The hub 61*b* bulges downward (one side in the axial direction) at a central portion (the rotation axis R of the centrifugal blower 40 and the vicinity thereof) of the main plate 61. The hub 61*b* covers the drive portion 50 from the lower side (one side in the axial direction) and from the outside in the radial direction. That is, an accommodation space for accommodating the drive portion 50 is formed inside the hub 61*b* in the radial direction.

The hub 61*b* has a diameter that decreases toward the lower side. The hub 61*b* has a flat plate portion 61*d* and a conical portion 61*c*. The flat plate portion 61*d* is located on the lower side of the drive portion 50. The flat plate portion 61*d* has a flat plate shape that is orthogonal to the rotation axis R. The flat plate portion 61*d* is circular in plan view. The conical portion 61*c* extends upward from an outer edge of the flat plate portion 61*d*. The conical portion 61*c* has a conical shape that is widened outward in the radial direction toward the upper side. The conical portion 61*c* surrounds the drive portion 50 from the outside in the radial direction. A curved portion 61*ca* smoothly connected to the flat plate portion 61*d* is formed at a lower end portion of the conical portion 61*c*. The conical portion 61*c* is curved at a certain curvature at the curved portion 61*ca*. The conical portion 61*c* gradually increases in inclination toward the upper side from the flat plate portion 61*d* at the curved portion 61*ca*. In addition, the conical portion 61*c* has a certain inclination in a region on the upper side of the curved portion 61*ca*.

The hub 61*b* has a plurality of (seven in the present embodiment) guide portions 70 protruding outward in the radial direction. In the present embodiment, the guide portion 70 is formed in the curved portion 61*ca* of the conical portion 61*c*. That is, the guide portion 70 protrudes outward in the radial direction from an outer peripheral surface of the curved portion 61*ca*. The plurality of guide portions 70 are disposed at intervals from each other in the rotation direction of the rotation axis R. One air hole 61*f* is formed in each of the guide portions 70. The air hole 61*f* guides air from a space inside the hub 61*b* in the radial direction to a space outside in the radial direction. The guide portion 70 will be described in more detail below.

The shaft holding portion 61*e* is disposed at the center of the flat plate portion 61*d* of the hub 61*b*. The shaft holding portion 61*e* has a cylindrical shape centered on the rotation axis R. The rotary shaft 52 is disposed inside the shaft holding portion 61*e*. In addition, a connecting member 53 is fixed to an inner peripheral surface of the shaft holding portion 61*e*. The connecting member 53 connects an outer peripheral surface of the rotary shaft 52 and the inner peripheral surface of the shaft holding portion 61*e*.

The base 61*a* extends outward in the radial direction from an upper end of the hub 61*b*. The base 61*a* has a flat plate shape extending along a plane orthogonal to the rotation axis R. The base 61*a* is an annular portion whose outer peripheral edge is circular in plan view.

An upper surface (surface facing the other side in the axial direction) of the base 61*a* faces the top plate portion 12*a* of the housing 11 with a gap therebetween. The sub-flow BF flows through a gap between the upper surface of the base 61*a* and the top plate portion 12*a*. An upper support portion 61*p* to which the plurality of vane portions 63 are fixed by fixing means such as welding is formed on a lower surface (surface facing one side in the axial direction) of the base 61*a*.

The shroud 62 is an annular plate member. The shroud 62 faces the main plate 61 in the axial direction. A gap through which the main flow AF flows is formed between the main plate 61 and the shroud 62. An inner edge of the shroud 62 protrudes downward in a tubular shape to form the intake port 60*a* for guiding air to the main flow AF.

A lower support portion 62*p* to which the plurality of vane portions 63 are fixed by fixing means such as welding is formed in the shroud 62. The lower support portion 62*p* has a recessed portion that is recessed downward and into which the vane portion 63 is inserted, and the vane portion 63 is fixed in the recessed portion.

The plurality of vane portions 63 connect the main plate 61 and the shroud 62. That is, the plurality of (seven in the present embodiment) vane portions 63 are disposed between the main plate 61 and the shroud 62. The vane portion 63 has a hollow plate shape extending along the rotation axis R. The vane portion 63 is welded and fixed to the shroud 62 at a lower end portion, and is welded and fixed to the main plate 61 at an upper end portion.

The vane portion 63 is inclined to the rear side in the rotation direction T as it extends from the inside in the radial direction to the outside in the radial direction. The plurality of vane portions 63 push out air between the main plate 61 and the shroud 62 outward in the radial direction as the impeller 60 rotates around the rotation axis R. Accordingly, the impeller 60 forms the main flow AF in which the air is sent from the intake port 60*a* to the exhaust port 60*b*.

Next, the guide portion 70 of the present embodiment will be described in detail.

Figure 5:
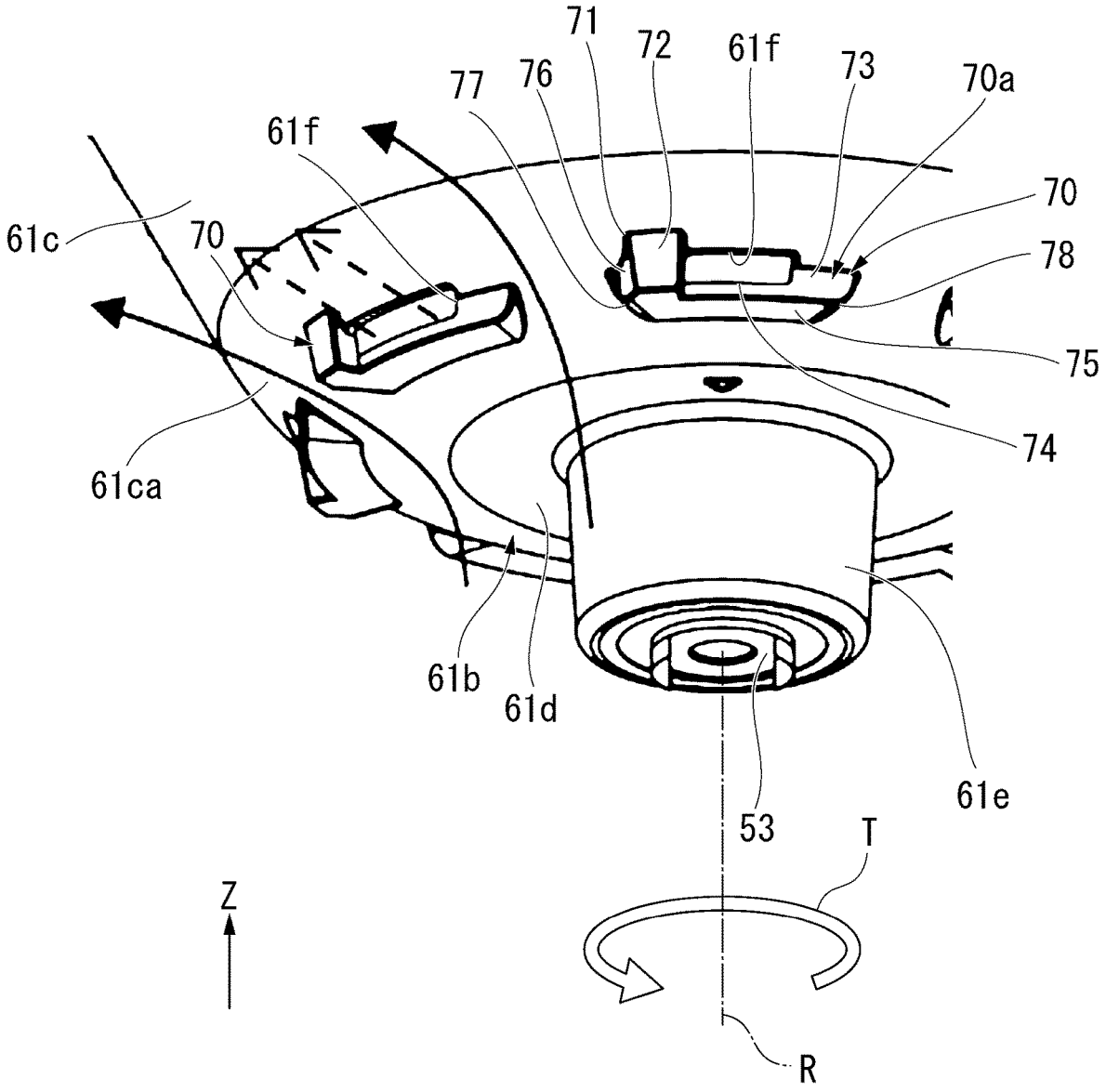
FIG. 5 is a perspective view of the vicinity of a lower end portion of a hub in the embodiment.
Figure 6:
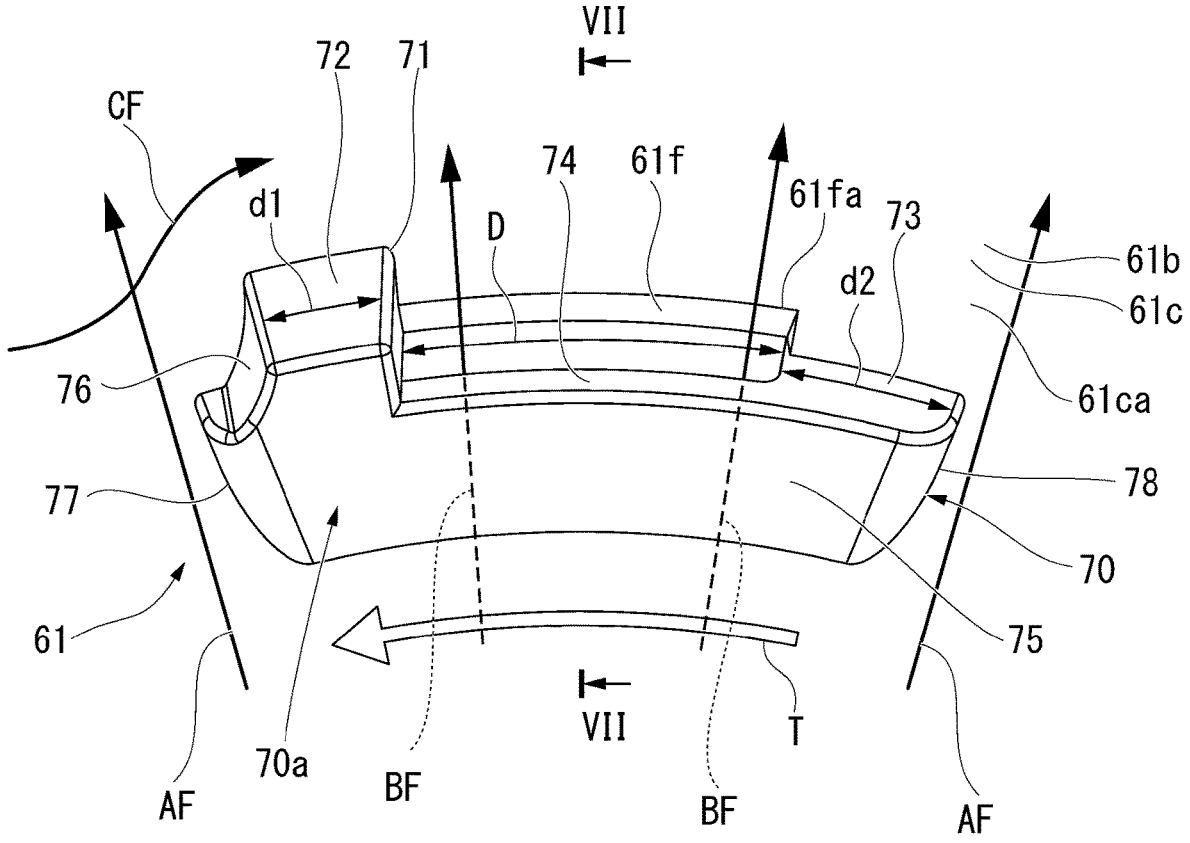
FIG. 6 is a plan view of a guide portion in the embodiment.
Figure 7:
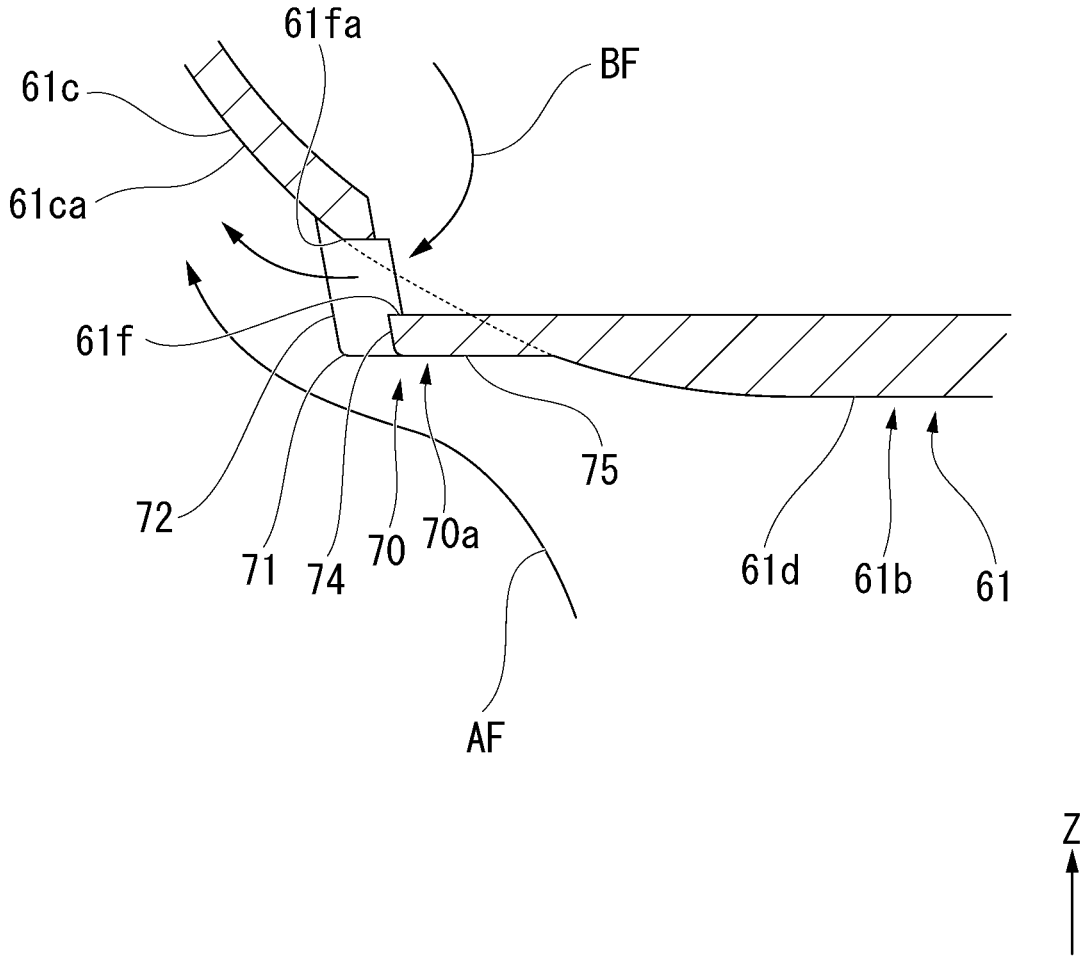
FIG. 7 is a sectional view of the guide portion taken along the line VII-VII of FIG. 6.

FIG. 5 is a perspective view of the vicinity of a lower end portion of the hub 61*b*. FIG. 6 is a plan view of the guide portion 70. FIG. 7 is a sectional view of the guide portion 70 taken along the line VII-VII of FIG. 6.

As shown in FIG. 5, the air hole 61*f* formed in the guide portion 70 penetrates the hub 61*b* in a thickness direction. The air hole 61*f* is open outward in the radial direction. The air hole 61*f* has a substantially rectangular shape when viewed from the opening direction. The opening direction of the air hole 61*f* need only have a component facing outward in the radial direction, and need not necessarily match the radial direction in a strict sense.

According to the present embodiment, since the air hole 61*f* is open outward in the radial direction, the air of the sub-flow BF flowing downward in the space inside the hub 61*b* in the radial direction can be smoothly guided to the outside of the hub 61*b* in the radial direction. Therefore, a flow path resistance of the sub-flow BF can be reduced to increase the flow rate of the sub-flow BF, and the cooling efficiency of the drive portion 50 can be increased.

As shown in FIG. 6, an outer peripheral surface 70*a* of the guide portion 70 has a first peripheral surface portion (peripheral surface portion) 72, a second peripheral surface portion (peripheral surface portion) 73, a third peripheral surface portion 74, an overhang surface portion 75, a connection surface portion 76, a front side surface portion 77, and a rear side surface portion 78.

The first peripheral surface portion 72, the second peripheral surface portion 73, and the third peripheral surface portion 74 are surfaces facing outward in the radial direction. Each of the first peripheral surface portion 72, the second peripheral surface portion 73, and the third peripheral surface portion 74 extends in the rotation direction. The first peripheral surface portion 72, the second peripheral surface portion 73, and the third peripheral surface portion 74 are curved surfaces that are gently curved around the rotation axis R.

The first peripheral surface portion 72 is located on the front side in the rotation direction T with respect to the air hole 61*f*. On the other hand, the second peripheral surface portion 73 is located on the rear side in the rotation direction T with respect to the air hole 61*f*. That is, the outer peripheral surface 70*a* of the guide portion 70 has a pair of peripheral surface portions 72 and 73 located on the front side and the rear side in the rotation direction T with respect to the air hole 61*f*.

The guide portion 70 of the present embodiment has the first peripheral surface portion 72 and the second peripheral surface portion 73 that are disposed on both sides of the air hole 61*f* in the rotation direction (that is, both sides in the circumferential direction). Accordingly, the main flow AF flowing on one side and the other side in the circumferential direction of the guide portion 70 can pass apart from the air hole 61*f* in the circumferential direction. The air of the sub-flow BF blown out from the air hole 61*f* merges with the main flow AF in a state of being sufficiently diffused. As a result, it is possible to suppress the generation of turbulent flow when the sub-flow BF merges with the main flow AF and to suppress the noise accompanying the merging.

Lengths d1 and d2 of the first peripheral surface portion 72 and the second peripheral surface portion 73 (a pair of peripheral surface portions located on both sides of the air hole 61*f* in the rotation direction) in the rotation direction are preferably shorter than a length D of the air hole 61*f* in the rotation direction. In order to reduce the flow path resistance of the sub-flow BF and increase the flow rate of the sub-flow BF, it is preferable to make the length D of the air hole 61*f* in the rotation direction as large as possible. On the other hand, the noise at the time of the merging of the sub-flow BF and the main flow AF is easily suppressed by increasing the lengths d1 and d2 of the first peripheral surface portion 72 and the second peripheral surface portion 73 in the rotation direction. However, when the lengths d1 and d2 of the first peripheral surface portion 72 and the second peripheral surface portion 73 in the rotation direction are too long, the circumferential dimension of the guide portion 70 increases, which may hinder the flow of the main flow AF along the outer peripheral surface of the hub 61*b*.

According to the present embodiment, the lengths d1 and d2 of the first peripheral surface portion 72 and the second peripheral surface portion 73 in the rotation direction are made smaller than the length D of the air hole 61*f* in the rotation direction, whereby it is possible to prevent the guide portion 70 from being too large while securing the flow rate of the sub-flow BF.

The first peripheral surface portion 72 is a surface formed on a surface of a protrusion portion 71 protruding outward in the radial direction with respect to an opening 61*fa* of the air hole 61*f*. Therefore, the first peripheral surface portion 72 is disposed on the outside in the radial direction with respect to the opening 61*fa* of the air hole 61*f*.

In the present specification, the opening 61*fa* of the air hole 61*f* means a region surrounded by an edge on the outside of the air hole 61*f* in a penetration direction.

When the impeller 60 rotates, the guide portion 70 rotates relatively with respect to the air inside the impeller 60. Therefore, a relative air flow (hereinafter, referred to as a swirling flow CF) toward the side opposite to the rotation direction T of the impeller 60 is generated around the guide portion 70.

According to the present embodiment, the first peripheral surface portion 72 located on the front side in the rotation direction T with respect to the air hole 61*f* is disposed on the outside in the radial direction with respect to the opening 61*fa* of the air hole 61*f*. A direction of the swirling flow CF is changed by the protrusion portion 71 on the front side in the rotation direction T of the air hole 61*f*, and the swirling flow CF flows in the circumferential direction along the first peripheral surface portion 72. According to the present embodiment, the first peripheral surface portion 72 is located on the outside in the radial direction with respect to the opening 61*fa* of the air hole 61*f*, so that, the swirling flow CF can pass apart from the opening 61*fa* of the air hole 61*f* outward in the radial direction. Accordingly, it is possible to prevent the sub-flow BF blown out from the air hole 61*f* from colliding with the swirling flow CF, and it is possible to suppress the generation of turbulent flow and the like when the sub-flow BF merges with the swirling flow CF and to suppress the noise accompanying the merging. In addition, by causing the swirling flow CF to pass apart from the air hole 61*f*, it is possible to prevent the air of the swirling flow CF from flowing into the air hole 61*f* and to secure the flow rate of the sub-flow BF blown out from the air hole 61*f*. Furthermore, it is possible to prevent the swirling flow CF from colliding with an edge portion of the air hole 61*f* and to suppress the noise generation due to the vibration of the edge portion.

The second peripheral surface portion 73 is disposed to be continuous to the opening 61*fa* of the air hole 61*f*. Therefore, a radial position of the opening 61*fa* of the air hole 61*f* matches a radial position of the second peripheral surface portion 73. In addition, the second peripheral surface portion 73 is disposed on the inside in the radial direction with respect to the first peripheral surface portion 72.

According to the present embodiment, the second peripheral surface portion 73 on the rear side in the rotation direction T of the air hole 61*f* does not protrude from the opening 61*fa* of the air hole 61*f*. Therefore, it is possible to cause the air blown out from the air hole 61*f* to smoothly flow to the rear side in the rotation direction T, and to promote the smooth merging of the swirling flow CF and the sub-flow BF.

The third peripheral surface portion 74 is located on the lower side (one side in the axial direction) of the air hole 61*f*. The third peripheral surface portion 74 is disposed to be continuous to the opening 61*fa* of the air hole 61*f*. Therefore, the second peripheral surface portion 73 and the third peripheral surface portion 74 are disposed to be continuous to each other in the rotation direction.

The overhang surface portion 75 is located on the lower side (one side in the axial direction) of the air hole 61*f*. In addition, the overhang surface portion 75 faces the lower side (one side in the axial direction). The overhang surface portion 75 is a surface extending in the rotation direction. The entire rotation direction of the overhang surface portion 75 includes the entire rotation direction of the air hole 61*f*. That is, an end portion of the overhang surface portion 75 on one side in the circumferential direction is located closer to one side in the circumferential direction than an end portion of the air hole 61*f* on one side in the circumferential direction, and an end portion of the overhang surface portion 75 on the other side in the circumferential direction is located closer to the other side in the circumferential direction than an end portion of the air hole 61*f* on the other side in the circumferential direction. The overhang surface portion 75 is connected to the first peripheral surface portion 72, the second peripheral surface portion 73, and the third peripheral surface portion 74 via a corner portion.

As shown in FIG. 7, a part of the main flow AF flowing outward in the radial direction along the outer peripheral surface of the hub 61*b* hits the guide portion 70, and passes through the lower side of the overhang surface portion 75 and the outside in the radial direction of the third peripheral surface portion 74. According to the present embodiment, the third peripheral surface portion 74 is disposed on the lower side (one side in the axial direction) of the air hole 61*f*, so that the main flow AF flowing on the lower side of the overhang surface portion 75 can pass apart from the opening 61*fa* of the air hole 61*f* in the axial direction. Accordingly, it is possible to prevent the collision between the main flow AF and the sub-flow BF at the time of the merging of the main flow AF and the sub-flow BF, and to smoothly merge the main flow AF and the sub-flow BF.

According to the present embodiment, the main flow AF flowing upward toward the guide portion 70 changes its flow outward in the radial direction when hitting the overhang surface portion 75 located on the lower side of the air hole 61*f* and facing the lower side. Accordingly, it is possible to prevent the main flow AF from flowing into the air hole 61*f* that is open outward in the radial direction, and to secure the flow rate of the sub-flow BF. Furthermore, it is possible to prevent the main flow AF from colliding with an edge portion of the air hole 61*f* and to suppress the noise generation due to the vibration of the edge portion.

As shown in FIG. 6, the front side surface portion 77 faces the front side in the rotation direction T. The front side surface portion 77 is a surface extending in the radial direction. The front side surface portion 77 is located on the front side in the rotation direction T with respect to the first peripheral surface portion 72. The front side surface portion 77 receives the swing flow CF.

The connection surface portion 76 connects the first peripheral surface portion 72 and the front side surface portion 77. The connection surface portion 76 faces in a direction slightly inclined outward in the radial direction with respect to the front side in the rotation direction T on the front side in the rotation direction T. The connection surface portion 76 is a surface formed on the surface of the protrusion portion 71. The connection surface portion 76 is inclined inward in the radial direction from the first peripheral surface portion 72 toward the front side surface portion 77.

The swirling flow CF changes its flow outward in the radial direction when hitting the front side surface portion 77, and flows along the first peripheral surface portion 72. According to the present embodiment, since the connection surface portion 76 connecting the first peripheral surface portion 72 and the front side surface portion 77 is formed on the outer peripheral surface of the guide portion 70, the swirling flow CF that has hit the front side surface portion 77 can be smoothly guided along the first peripheral surface portion 72. Accordingly, it is possible to suppress the occurrence of turbulent flow in the swirling flow CF and to increase the rotation efficiency of the impeller 60.

In the present embodiment, the connection surface portion 76 is a curved surface that is concavely curved. However, the connection surface portion 76 may be a convexly curved surface that smoothly connects the first peripheral surface portion 72 and the front side surface portion 77 with a uniform radius of curvature. In addition, the connection surface portion 76 may be a flat tapered surface that linearly connects the first peripheral surface portion 72 and the front side surface portion 77.

The rear side surface portion 78 faces the rear side in the rotation direction T. The front side surface portion 77 is a surface extending in the radial direction. The rear side surface portion 78 is located on the rear side in the rotation direction T with respect to the second peripheral surface portion 73. The rear side surface portion 78 is connected to the second peripheral surface portion 73 via a corner portion.

As shown in FIG. 4, in the present embodiment, the plurality of guide portions 70 are disposed at intervals from each other in the rotation direction. Similarly, the plurality of vane portions 63 are disposed at intervals from each other in the rotation direction. Furthermore, the number of the guide portions 70 matches the number of the vane portions 63. The intervals between the plurality of guide portions 70 in the rotation direction and the intervals between the plurality of vane portions 63 in the rotation direction may be the same as or different from each other. According to the present embodiment, by making the guide portions 70 and the vane portions 63 equal in number and disposing the guide portions 70 and the vane portions 63 at intervals from each other, it is possible to suppress variation in weight balance in the rotation direction of the impeller 60 and to increase the rotation efficiency of the impeller 60.

In addition, according to the present embodiment, by making the guide portions 70 and the vane portions 63 equal in number and disposing the guide portions 70 and the vane portions 63 at intervals from each other, it is possible to suppress variation in flow velocity of the air blown out from the air hole 61*f* of the guide portion 70 and sent to the outside in the radial direction by the vane portions 63. Therefore, it is possible to suppress variation in air resistance in the rotation direction of the impeller 60 and to increase the rotation efficiency of the impeller 60.

Although the embodiment of the present disclosure has been described, the present disclosure is not limited to the configurations of the embodiment described above, and the following configurations and methods can also be adopted.

In the above-described embodiment, the main plate, the shroud, and the plurality of vane portions of the impeller have been described as being separate members and being fixed to each other. However, the main plate, the shroud, and the plurality of vane portions may be parts of a single member. In addition, the main plate, the shroud, and the vane portion may each be formed by combining a plurality of members.

In the above-described embodiment, a case in which the centrifugal blower is adopted in the ceiling-embedded indoor unit has been described. However, the centrifugal blower of the embodiment can also be used for other types of indoor units, and can be widely used for various devices provided with blowing means other than the air conditioner. The heat exchanger shown in the above-described embodiment is merely an example of a pressure loss body placed in a flow path of air generated by the centrifugal blower in the air conditioner. Therefore, for example, as the pressure loss body placed in the flow path of the air generated by the centrifugal blower in an air purification device, an air purification filter can be used. That is, the centrifugal blower described in the above-described embodiment can also be adopted as a blower in the air purification device.

As described above, each configuration and each method described in the present specification can be combined as appropriate to the extent that they are consistent with each other.

The invention claimed is:

1. A centrifugal blower comprising:

a drive portion having a rotary shaft that rotates about a rotation axis; and an impeller that is disposed on one side in an axial direction of the rotation axis with respect to the drive portion and is configured to be rotated forward in a rotation direction around the rotation axis by the drive portion, wherein the impeller includes a main plate fixed to the rotary shaft, a shroud having an annular shape and facing the main plate in the axial direction, and a plurality of vane portions connecting the main plate and the shroud, the main plate has a hub that covers the drive portion from the one side in the axial direction and from an outside in a radial direction of the rotation axis, the hub has a plurality of guide portions protruding outward in the radial direction and arranged in the rotation direction, air holes that are open outward in the radial direction are formed in the plurality of guide portions, and each outer peripheral surface of the plurality of guide portions has a first peripheral surface portion and a second peripheral surface portion, the first peripheral surface portion being located on a front side in the rotation direction with respect to the air hole and facing outward in the radial direction, the second peripheral surface portion being located on a rear side in the rotation direction with respect to the air hole and facing outward in the radial direction, and the second peripheral surface portion extends in the rotation direction and is disposed to be continuous to an opening of the air hole in the rotation direction such that a radial position of the opening of the air hole matches a radial position of the second peripheral surface portion.

2. The centrifugal blower according to claim 1, wherein the first peripheral surface portion extends in the rotation direction, and is disposed on the outside in the radial direction with respect to an opening of the air hole.

3. The centrifugal blower according to claim 2, wherein the outer peripheral surface of the guide portion has a front side surface portion located on the front side in the rotation direction with respect to the first peripheral surface portion and facing the front side in the rotation direction, and a connection surface portion connecting the first peripheral surface portion and the front side surface portion, and the connection surface portion is inclined inward in the radial direction from the first peripheral surface portion toward the front side surface portion.

4. The centrifugal blower according to claim 1, wherein a length of each of the first peripheral surface portion and the second peripheral surface portion in the rotation direction is shorter than a length of the air hole in the rotation direction.

5. The centrifugal blower according to claim 1, wherein the outer peripheral surface of the guide portion has a third peripheral surface portion located on one side of the air hole in the axial direction and facing outward in the radial direction.

6. The centrifugal blower according to claim 1, wherein the outer peripheral surface of the guide portion has a third peripheral surface portion located on one side of the air hole in the axial direction and facing outward in the radial direction, and an overhang surface portion located on one side of the air hole in the axial direction and facing the one side in the axial direction, and the overhang surface portion is connected to the first peripheral surface portion, the second peripheral surface portion, and the third peripheral surface portion via a corner portion.

7. The centrifugal blower according to claim 1, wherein the plurality of guide portions are disposed at intervals from each other in the rotation direction, the plurality of vane portions are disposed at intervals from each other in the rotation direction, and the number of the guide portions matches the number of the vane portions.

8. An indoor unit comprising:

centrifugal blower according to claim 1; and a heat exchanger disposed around the centrifugal blower.

* * * * *